US010054377B2

(12) United States Patent
Xue et al.

(10) Patent No.: US 10,054,377 B2
(45) Date of Patent: Aug. 21, 2018

(54) AIR CONDITIONER

(71) Applicant: Johnson Controls-Hitachi Air Conditioning Technology (Hong Kong) Limited, Hong Kong (CN)

(72) Inventors: Jun Xue, Tokyo (JP); Takumi Kamiaka, Tokyo (JP); Kazumoto Urata, Tokyo (JP); Masayoshi Murofushi, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 143 days.

(21) Appl. No.: 15/230,626

(22) Filed: Aug. 8, 2016

(65) Prior Publication Data

US 2017/0067697 A1 Mar. 9, 2017

(30) Foreign Application Priority Data

Sep. 8, 2015 (JP) ..... 2015-176452

(51) Int. Cl.

| | |
|---|---|
| ***F25B 39/02*** | (2006.01) |
| ***F28F 9/02*** | (2006.01) |
| ***F25B 13/00*** | (2006.01) |
| ***F28D 1/047*** | (2006.01) |

(52) U.S. Cl.

CPC ..... *F28F 9/0275* (2013.01); *F25B 13/00* (2013.01); *F25B 39/028* (2013.01); *F28D 1/0477* (2013.01); *F25B 2313/005* (2013.01); *F25B 2313/006* (2013.01); *F25B 2313/023* (2013.01); *F25B 2313/02741* (2013.01); *F25B 2500/09* (2013.01)

(58) Field of Classification Search

CPC .... F28F 9/0275; F28D 1/0477; F25B 39/028; F25B 39/02; F25B 2313/006; F25B 13/00; F25B 39/00; F25B 2313/023

USPC ..... 165/173

See application file for complete search history.

(56) References Cited

U.S. PATENT DOCUMENTS

| | | | | |
|---|---|---|---|---|
| 2006/0048928 A1* | 3/2006 | Maezawa | F25B 39/00 | 165/173 |
| 2008/0011463 A1* | 1/2008 | Timbs | F28D 1/0477 | 165/151 |
| 2008/0053120 A1* | 3/2008 | Nakai | F25B 13/00 | 62/157 |

FOREIGN PATENT DOCUMENTS

JP 2011-112303 A 6/2011

* cited by examiner

*Primary Examiner* — Ana Vazquez

(74) *Attorney, Agent, or Firm* — Mattingly & Malur, PC

(57) ABSTRACT

Task: To provide a high quality air conditioner with high efficiency and stability, preventing adverse effect of manufacturing variation on the refrigerant distribution.

Solution: The air conditioner having an expansion valve for decompressing a refrigerant, and a heat exchanger for heat exchange between the refrigerant and air. The air conditioner includes a first linearly shaped piping that is connected to the expansion valve and vertically disposed, a branch pipe connected to the first piping for branching a refrigerant flow path into a plurality of sections, a plurality of second pipings connected to the branch pipe, and a plurality of distributors connected to the second piping for further branching the refrigerant flow path to the heat exchanger.

7 Claims, 8 Drawing Sheets

AIR CONDITIONER

CLAIM OF PRIORITY

The present application claims priority from Japanese Patent application serial No. 2015-176452, filed on Sep. 8, 2015, the content of which is hereby incorporated by reference into this application.

TECHNICAL FIELD

The present invention relates to an air conditioner.

BACKGROUND ART

The outdoor unit of upward blow-off type has been known as the outdoor unit used for the air conditioner, which is configured to take in air from its rear, left and right side surfaces by rotation of the fan disposed at the upper part for blowing air upward.

The outdoor unit of the aforementioned type is required to increase the front area of the heat exchanger in the limited space, that is, the peripheral length or height for the purpose of improving performance of air blowing and heat exchanging while suppressing the unit size. In order to satisfy the requirement, the method as disclosed in Japanese Unexamined Patent Application Publication No 2011-112303 (Patent Literature 1) has been proposed. Specifically, the disclosed structure has two fans arranged in parallel with each other at the upper part of the unit, and two heat exchangers each having substantially U-like shape are disposed to surround the respective fans. The header pipe for dividing the refrigerant into the respective refrigerant paths of the heat exchanger is disposed at one end proximal to the other heat exchanger so as to actualize the same heat exchanging performance with no need of distributing the refrigerant to the header pipe.

CITATION LIST

Patent Literature

Patent Literature 1: Japanese Unexamined Patent Application Publication No. 2011-112303

SUMMARY OF INVENTION

Technical Problem

The header pipes cannot be necessarily disposed in the same posture because of variations on manufacturing. In other words, the header pipe may be vertically disposed, or obliquely inclined to a slight degree. On the other hand, in the case of gas-liquid two-phase flow, it is known that the refrigerant distribution by means of the header pipe is greatly susceptible to the posture of the header pipe under the influence of gravity.

The outdoor unit having the header pipe disposed in the different posture is configured to allow the heat exchanger to function as an evaporator. That is, upon distribution of the divided refrigerant in the gas-liquid two-phase state to the respective refrigerant paths, the distribution state of the refrigerant may be different depending on the individual heat exchanger. For example, the plurality of heat exchanges fail to individually actualize the uniform heat exchanging performance, deteriorating efficiency of the outdoor unit. This may result in different performance for each of the outdoor units, leading to unevenness.

In the thus disclosed generally employed structure, the outdoor unit efficiency is likely to be greatly affected by the manufacturing variation, and to easily cause the individual difference.

The present invention has been made to solve the aforementioned problem, and it is an object of the present invention to actualize high efficiency of the air conditioner by eliminating the influence of the variation of manufacturing on the refrigerant distribution, and to stabilize quality of the product.

Solution to Problem

The present invention provides an air conditioner having an expansion valve for decompressing a refrigerant, and a heat exchanger for heat exchange between the refrigerant and air. The air conditioner includes a first linearly shaped piping that is connected to the expansion valve and vertically disposed, a branch pipe connected to the first piping for branching a refrigerant flow path into a plurality of sections, a plurality of second pipings connected to the branch pipe, and a plurality of distributors connected to the second piping for further branching the refrigerant flow path to the heat exchanger.

Advantageous Effects of Invention

The present invention provides the high quality air conditioner with high efficiency and stability by eliminating the influence of manufacturing variation on the refrigerant distribution.

DESCRIPTION OF EMBODIMENTS

Figure 1:
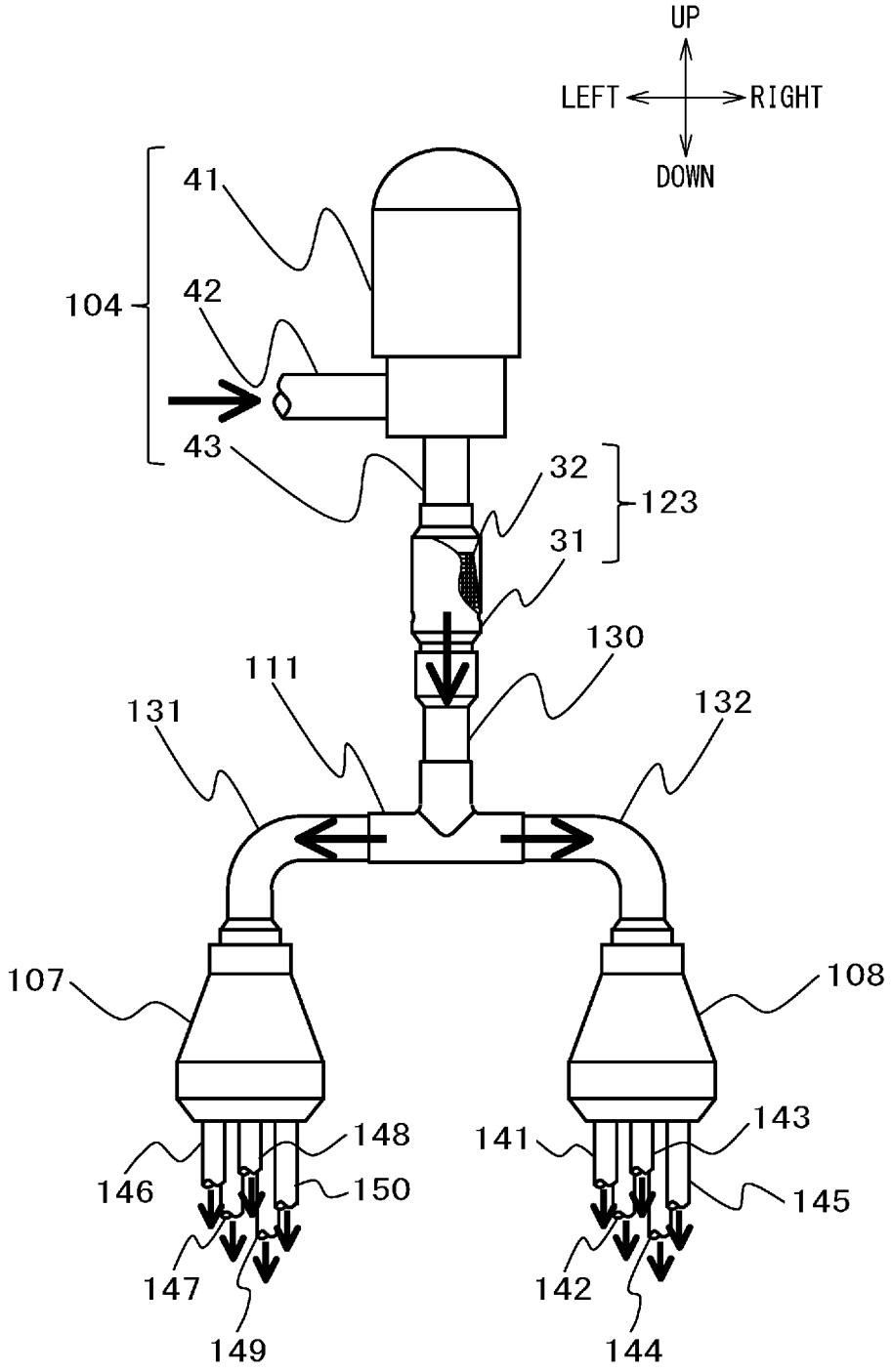
FIG. 1 is a schematic view showing a refrigerant distribution system according to a first embodiment.

Embodiments according to the present invention will be described in detail referring to the drawings.

First Embodiment

Figure 2:
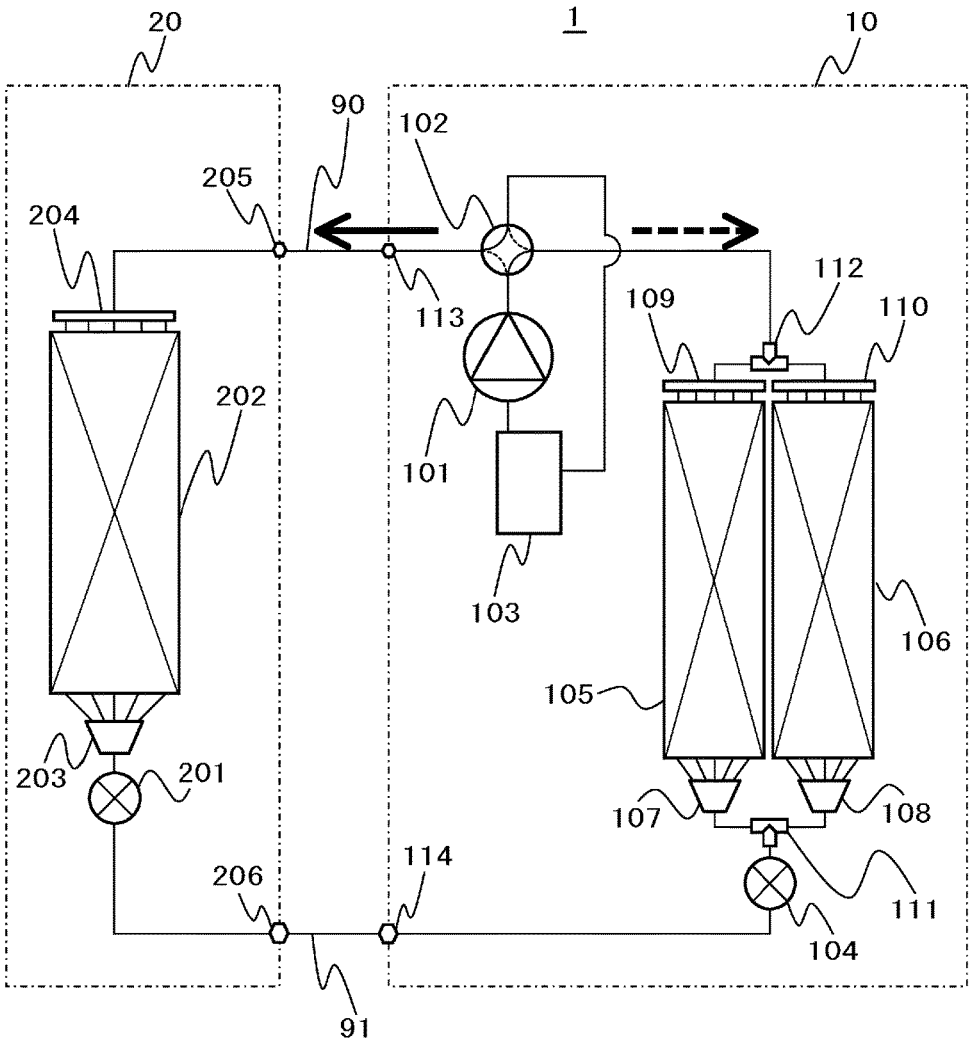
FIG. 2 is a system diagram showing a refrigeration cycle configuration of an air conditioner according to the first embodiment.

Referring to FIG. 2, the air conditioner according to this embodiment will be described. FIG. 2 is a system diagram showing a refrigeration cycle configuration of an air conditioner 1 (as an example of an air conditioner for business use). Referring to FIG. 2, the air conditioner 1 includes an outdoor unit 10, an indoor unit 20, and pipings 90, 91 for connection between the outdoor unit 10 and the indoor unit 20.

The outdoor unit 10 includes a compressor 101 for compressing the refrigerant, a four-way valve 102 for switching the refrigerant flow direction, an accumulator 103 for separating the refrigerant liquid which has not been vaporized by the evaporator, an outdoor expansion valve 104 for decompressing the refrigerant, outdoor heat exchangers 105, 106 for heat exchange between air fed from an outdoor fan (not shown) and the refrigerant, distributors (distribution units) 107, 108 and header pipes 109, 110 for dividing or converging the refrigerant flowing through the outdoor heat exchangers 105, 106, a branch pipe 111 for dividing or converging the refrigerant passing through the distributors 107, 108, a branch pipe 112 for dividing or converging the refrigerant passing through the header pipes 109, 110, a connection portion 113 for connection to the piping 90, and a connection portion 114 for connection to the piping 91.

Meanwhile, the indoor unit 20 includes an indoor expansion valve 201 for decompressing the refrigerant, an indoor heat exchanger 202 for heat exchange between indoor air fed from an indoor fan (not shown) and the refrigerant, a distributor 203 and a header pipe 204 for dividing or converging the refrigerant flowing through the indoor heat exchanger 202, a connection portion 205 for connection to the piping 90, and a connection portion 206 for connection to the piping 91.

Upon heating operation, the outdoor heat exchangers 105, 106 function as evaporators, and the indoor heat exchanger 202 functions as a condenser. As a solid arrow shows, the refrigerant is compressed by the compressor 101 to be discharged in a gaseous state at high pressure and high temperature. Thereafter, the refrigerant is divided by the header pipe 204 into five flows via the four-way valve 102 and the piping 90, which flows to the indoor heat exchanger 202. Within the indoor heat exchanger 202, the refrigerant releases heat to the indoor air fed from the indoor fan (not sown), and is converged by the distributor 203 after it is brought into the high pressure liquefied state at medium temperature. The refrigerant is decompressed as it passes through the indoor expansion valve 201, the piping 91, and the outdoor expansion valve 104, and transformed into the low pressure gas-liquid two-phase state at low temperature. The refrigerant is divided into two flows by the branch pipe 111, and each flow is further divided into five flows by the distributors 107, 108, respectively, which will flow into the outdoor heat exchangers 105, 106. Within the outdoor heat exchangers 105, 106, the refrigerant takes heat from the outside air fed from the outdoor fan (not shown), and evaporates into the low pressure gaseous state at low temperature. The flows are converged by the header pipes 109, 110, and the branch pipe 112, returning to the compressor 101 again via the four-way valve 102 and the accumulator 103.

Meanwhile, cooling operation is activated by switching the refrigerant flow direction by the four-way valve 102. In this case, the outdoor heat exchangers 105, 106 function as the condensers, and the indoor heat exchanger 202 functions as the evaporator. As the dashed arrow shows, the refrigerant circulates within the air conditioner 1 while changing its state in passing through the compressor 101, the four-way valve 102, the branch pipe 112, the header pipes 109, 110, the outdoor heat exchangers 105, 106, the distributors 107, 108, the branch pipe 111, the outdoor expansion valve 104, the piping 91, the indoor expansion valve 201, the distributor 203, the indoor heat exchanger 202, the header pipe 204, the piping 90, the four-way valve 102, the accumulator 103, and the compressor 101 sequentially in the order. In the circulating process, the refrigerant takes heat from the indoor air so as to be discharged outside.

The air conditioner according to the embodiment described herein is configured to include the single outdoor unit and the single indoor unit. However, the present invention may be applied to the air conditioner configured to include the single outdoor unit and a plurality of indoor units, or the plurality of outdoor units and the plurality of indoor units. The number of the outdoor heat exchangers, and the number of branches performed by the branch pipe, the distributor, and the header pipe may be arbitrarily determined so long as the plurality of branches are made.

Figure 3:
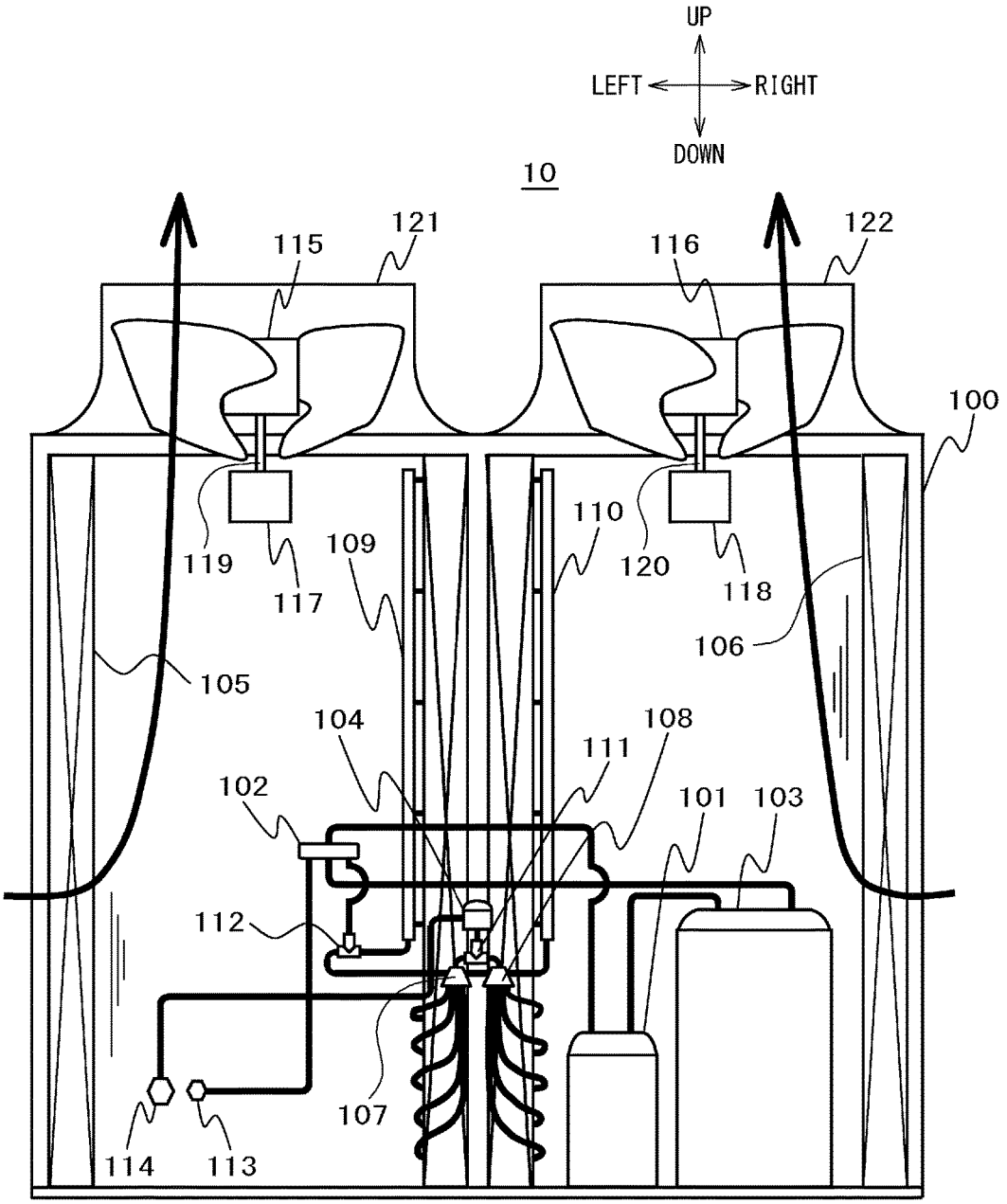
FIG. 3 is a front view schematically showing an outdoor unit according to the first embodiment.
Figure 4:
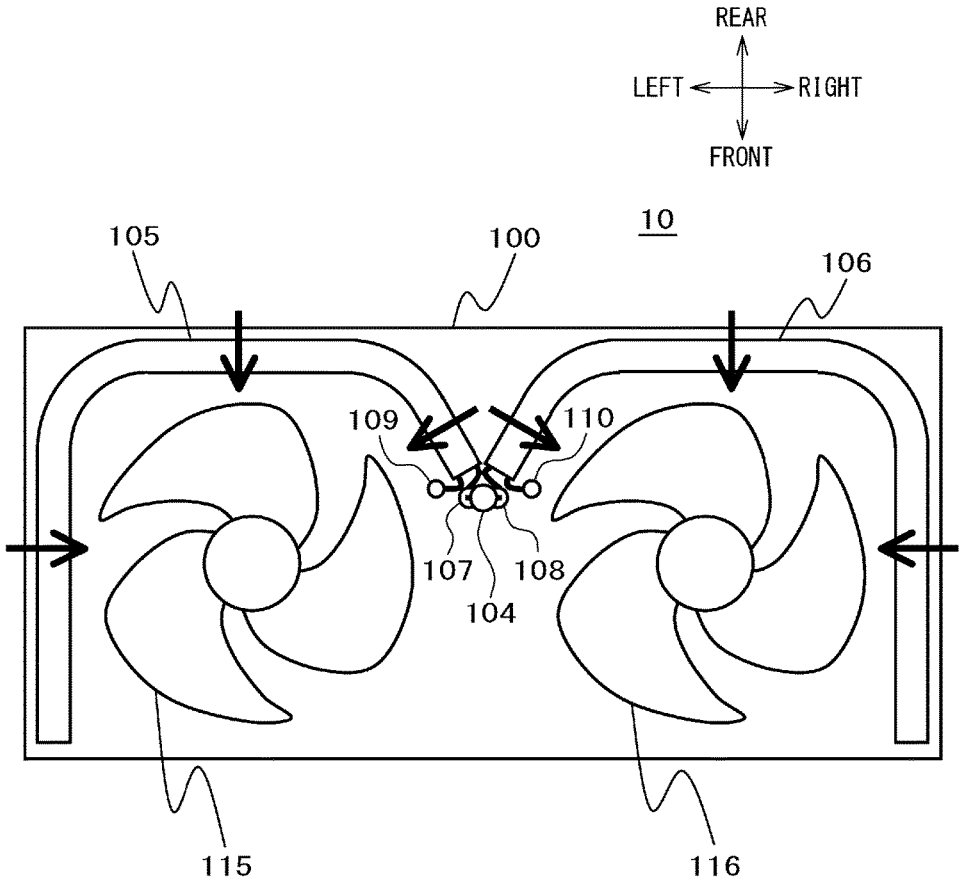
FIG. 4 is a plan view schematically showing the outdoor unit according to the first embodiment.

Referring to FIGS. 3 and 4, an example of the outdoor unit according to the embodiment will be described. FIGS. 3 and 4 are front and plan views of the outdoor unit 10 of upward blow-off type, respectively. The drawings show a housing 100, the compressor 101, the four-way valve 102, the accumulator 103, the outdoor expansion valve 104, the outdoor heat exchangers 105, 106, the distributors 107, 108, the header pipes 109, 110, the branch pipes 111, 112, connection portions 113, 114 for connection between the indoor unit and the outdoor unit, propeller fans 115, 116, motors 117, 118, shafts 119, 120, and bellmouths 121, 122. The thick line in the drawing indicates the piping for connecting the respective components, and arrows indicate the air flow.

The housing 100 has a rectangular parallelepiped shape, and openings formed in the rear, left, and right side surfaces for taking air over the whole surface. The upper surface of the housing has an opening for discharging air passing through the outdoor heat exchangers 105, 106 to the outside. A detachable service panel is attached to the front surface of the housing.

The bellmouths 121, 122 in parallel with each other are disposed on the housing 100 for smooth flow of air discharged outside the unit. The bellmouth 121 includes the propeller fan 115, the motor 117 for driving the propeller fan 115, which is positioned therebelow, and a shaft 119 for connecting the propeller fan 115 to the motor 117, which are arranged inside the bellmouth 121 coaxially therewith. The bellmouth 122 includes the propeller fan 116, a motor 118 for driving the propeller fan 116, which is positioned therebelow, and a shaft 120 for connecting the propeller fan 116 to the motor 118, which are arranged inside the bellmouth 122 coaxially therewith. The motors 117, 118 are fixed to the outdoor heat exchangers 105, 106, or the housing 100 by not shown clamps.

As the propeller fans 115, 116 are driven and rotated by the motors 117, 118, air is taken into the unit through the openings formed in the rear, left, and right side surfaces of the housing as indicated by the arrows in the drawing. The air passing through the outdoor heat exchangers 105, 106 is boosted by the propeller fans 115, 116, and fed to the outside of the unit by the bellmouths 121, 122, respectively.

The outdoor heat exchangers 105, 106 each having substantially a U-like shape and substantially the same height as that of the housing 100 are symmetrically arranged therein while surrounding the propeller fans 115, 116 respectively along both side surfaces and the rear surface of the housing 100. Each bent portion of the outdoor heat exchangers 105, 106 has the longer length at the side surface of the housing as shown in FIG. 4.

Figure 5:
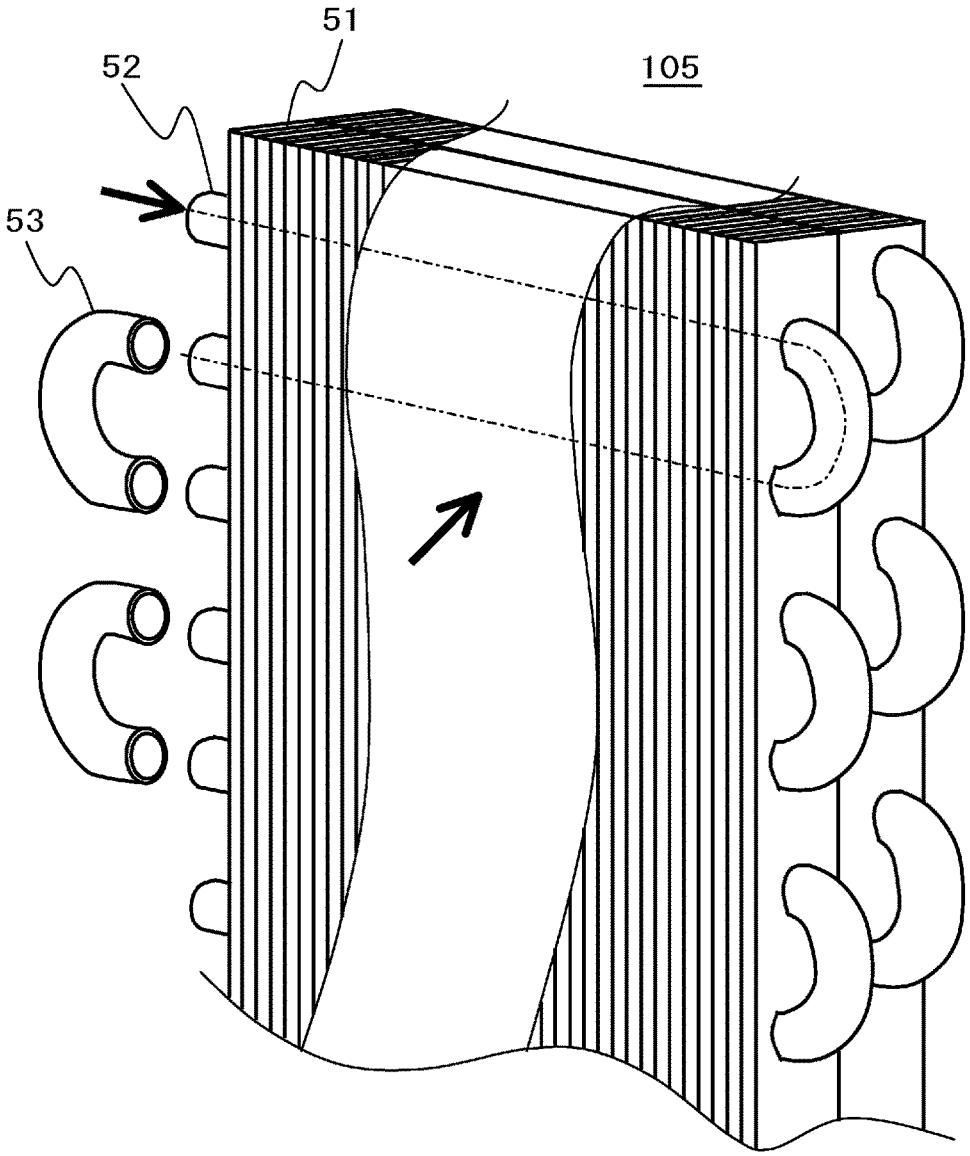
FIG. 5 is a perspective view schematically showing a heat exchanger according to the first embodiment.

The outdoor heat exchangers 105, 106 may be heat exchangers of cross-fin tube type as shown in FIG. 5, for example. The heat exchanger of the aforementioned type includes a plurality of U-shaped heat transfer pipes 52 which are arranged in parallel, a large number of thin plate fins 51 arranged along the axial direction of the heat transfer pipe 52 at constant intervals, and a plurality of return bends 53 for connecting the heat transfer pipes 52. The heat transfer pipe 52 is in tight contact with the fins 51 by the pipe expansion process while piercing through the fins 51. Heat exchange is performed between the refrigerant flowing in the heat transfer pipe 52 and air flowing through the gap between the fins 51 via the wall surfaces of the fins 51 and the heat transfer pipe 52.

Referring back to FIG. 3, there are a refrigerant distribution system A constituted by the branch pipe 111 and the distributors 107, 108, and a refrigerant distribution system B constituted by the branch pipe 112, and the header pipes 109, 110 at positions near the respective ends of the outdoor heat exchangers 105, 106 at the center of the housing 100.

In the heating operation when the outdoor heat exchangers 105, 106 function as the evaporators, the refrigerant distribution system A divides the refrigerant that has been passing through the outdoor expansion valve 104 in the gas-liquid two-phase state. In the cooling operation when the outdoor heat exchangers 105, 106 function as the condensers, the system A serves to converge the refrigerant liquid which has been condensed by the outdoor heat exchangers 105, 106.

In the heating operation when the outdoor heat exchangers 105, 106 function as the evaporators, the refrigerant distribution system B serves to converge the refrigerant gas vaporized by the outdoor heat exchangers 105, 106. In the cooling operation when the outdoor heat exchangers 105, 106 function as the condensers, the system B serves to divide the refrigerant gas from the compressor 101.

The compressor 101 and the accumulator 103 are disposed inside the outdoor heat exchanger 106, and fixed to the bottom plate of the housing 100.

The outdoor expansion valve 104 and the refrigerant distribution system A will be described. FIG. 1 is a schematic view showing the refrigerant distribution system according to the embodiment. FIG. 1 shows the outdoor expansion valve 104, the branch pipe 111, the distributors 107, 108, a strainer 123 for blocking intrusion of a foreign substance into the outdoor expansion valve 104, and pipings 130, 131, 132, 141, 142, 143, 144, 145, 146, 147, 148, 149, and 150. The arrows in the drawing represent the refrigerant flow in the heating operation when the outdoor heat exchangers 105, 106 function as the evaporators. In this case, the branch pipe 111, and the distributors 107, 108 serve to divide the refrigerant into flows in the gas-liquid two-phase state.

The outdoor expansion valve 104 includes a valve body 41, and two connecting pipes 42, 43. Although not shown in the drawing, a valve hole and a needle that can be vertically moved by the drive unit are formed inside the valve body 41. A doughnut-like refrigerant flow path is formed between the valve hole and the needle. The area of the refrigerant flow path may be adjusted by moving the needle.

The strainer 123 that is disposed at the lower side of the outdoor expansion valve 104, and joined with the connecting pipe 43 includes a substantially cylindrical casing 31, and a mesh member 32 built-in the casing 31 for removing the foreign substance from the refrigerant. The mesh member 32 is attached to the casing 31 through the caulking process, for example.

The branch pipe 111 that is disposed below the strainer 123, and joined therewith by using the piping 130 has an inverted T-like shape. The pipings 131, 132 each of which is bent downward for forming the L-like shape are attached to both ends of a straight part of the pipe that faces the piping 130. At the other ends of the pipings 131, 132, the distributors 107, 108 are disposed, respectively for dividing the refrigerant into five flows. The pipings 141, 142, 143, 144, 145 are connected to the distributor 108, and the pipings 146, 147, 148, 149, 150 are connected to the distributor 107.

The pipings 130, 131, 132 are processed to be expanded for alignment with the connection portions of the strainer 123, and the distributors 107, 108.

The refrigerant flow will be described by using the arrow in the drawing as well as the effect of the embodiment.

In the heating operation, the refrigerant distribution system A serves to divide the refrigerant in the gas-liquid two-phase state. Specifically, the refrigerant that is brought into liquid state through condensation by the indoor unit 20 flows into the outdoor expansion valve 104 from the connecting pipe 42 of the outdoor expansion valve via the strainer (not shown). Upon passage of the refrigerant through the doughnut-like refrigerant flow path formed in the outdoor expansion valve 104, the refrigerant is decompressed so that the refrigerant gas is accompanied with the spray flow or fine droplets, and the gas phase and the liquid phase are well mixed. Thereafter, the refrigerant impinges against the wall surface of the straight part of the branch pipe 111 after passing through the strainer 123 and the piping 130. The refrigerant flows separated leftward and rightward pass through the respective piping 131 or 132, and is divided into five flows by the distributors 107, 108 while keeping the spray flow state. Those flows are fed into the outdoor heat exchangers 105, 106 through the pipings 141, 142, 143, 144, 145, 146, 147, 148, 149, and 150.

In the embodiment, the piping 130 disposed between the outdoor expansion valve 104 and the branch valve 111, which is made into a straight shape is positioned in the vertical direction so as to form each of the pipings 131, 132 to have an L-like shape, which are disposed between the branch pipe 111 and the distributors 107, 108, respectively. This makes it possible to reduce the length of each flow path from the outdoor expansion valve 104 to the distributors 107, 108 as short as possible. This allows division of the refrigerant into flows before the gas phase and the liquid phase in the refrigerant are separated, that is, the spray flow state is retained. Even if manufacturing variation occurs, the distribution property of the spray flow is hardly influenced by the posture of the disposed distributor. Therefore, the predetermined heat exchange performance may be actualized without changing the refrigerant distribution state to the outdoor heat exchangers 105, 106. As the distributors 107, 107 are vertically disposed, the refrigerant flow path inside the distributor is vertically directed so as to avoid the influence of gravity on the refrigerant distribution. Each of the pipings 130, 131, 132 is short and simply structured, the manufacturing cost may be reduced.

The branch pipe 111 has a T-like shape (inverted T-like shapes), which allows the flow direction of the refrigerant which has been divided by the branch pipe 111 to form the same angle, that is, 90° with respect to the flow direction of the refrigerant before division. This makes it possible to prevent the inertial force from affecting the refrigerant distribution. Impingement of the refrigerant against the wall surface at the straight part of the branch pipe 111 contributes to prevention of separation of the phase into gas and liquid. The branch pipe 111 may have a Y-like shape (inverted Y-like shape) and a U-like shape (inverted U-like shape) as the one that forms the same angle. The pipings 131 and 132 do not necessarily have to be L-like shaped.

In the cooling operation, the refrigerant flows in the reverse direction as indicated by the arrow in the drawing. Specifically, the refrigerant which has been condensed by the outdoor heat exchangers 105, 106 to be brought into the liquid state is converged by the distributors 107, 108, and the branch pipe 111, and passes through the strainer 123 and the outdoor expansion valve 104. The foreign substance associated with the refrigerant by any chance may be eliminated by the mesh member 32 built in the strainer 123 so as to prevent failure of the outdoor expansion valve owing to intrusion of the foreign substance.

Figure 6:
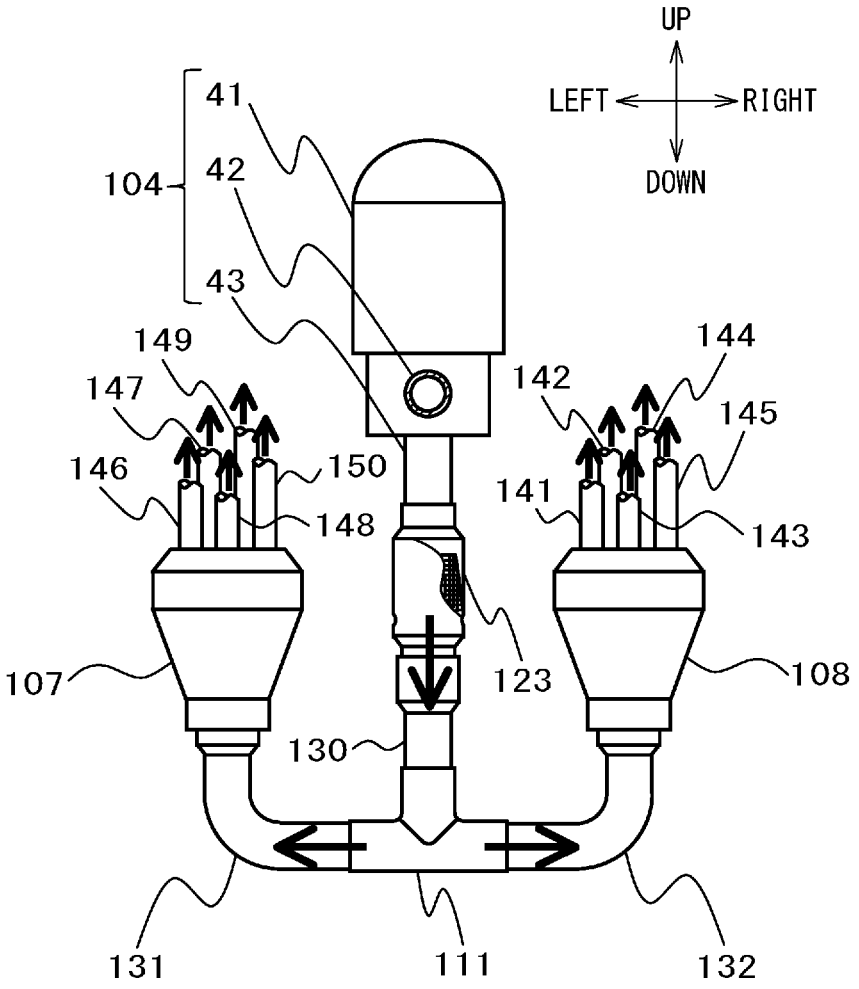
FIG. 6 is a schematic view showing another example of the refrigerant distribution system according to the first embodiment.

The above description has been made in the case where the distributors 107, 108 are disposed downward. However, they may be disposed upward as FIG. 6 shows. The connecting pipe 42 of the outdoor expansion valve 104 may be arranged in parallel with the straight part of the branch pipe 111 as indicated by FIG. 1. It may also be arranged perpendicularly, or obliquely as indicated by FIG. 6. The number of branches of the branch pipes 111 may be varied in accordance with the number of the heat exchangers. In this case, preferably, the flow direction of the divided refrigerant is at the same angle as that of the flow direction of the refrigerant before division. The number of branches of the distributors may also be varied in accordance with the number of the refrigerant flow paths of the heat exchanger. The distributor may have an arbitrary shape so long as the refrigerant flow path is branched.

As described above, the air conditioner according to the embodiment includes the outdoor expansion valve 104 for decompressing the refrigerant, the outdoor heat exchangers 105, 106 for heat exchange between the refrigerant and air, the linearly-shaped first piping 130 which is connected to the expansion valve and vertically disposed, the branch pipe 111 which is connected to the first piping for branching the refrigerant flow path into a plurality of sections, the plurality of second pipings 131, 132 which are connected to the branch pipe, and the plurality of distributors 107, 108 which further branch the refrigerant flow path to the heat exchanger, which is connected to the second piping.

This makes it possible to prevent influence of manufacturing variation on the refrigerant distribution, resulting in high quality air conditioner with high efficiency and stability.

Second Embodiment

The following is the description of an example that the refrigerant distribution is adjustable in accordance with each heat exchanging capacity of the respective heat exchangers.

Figure 7:
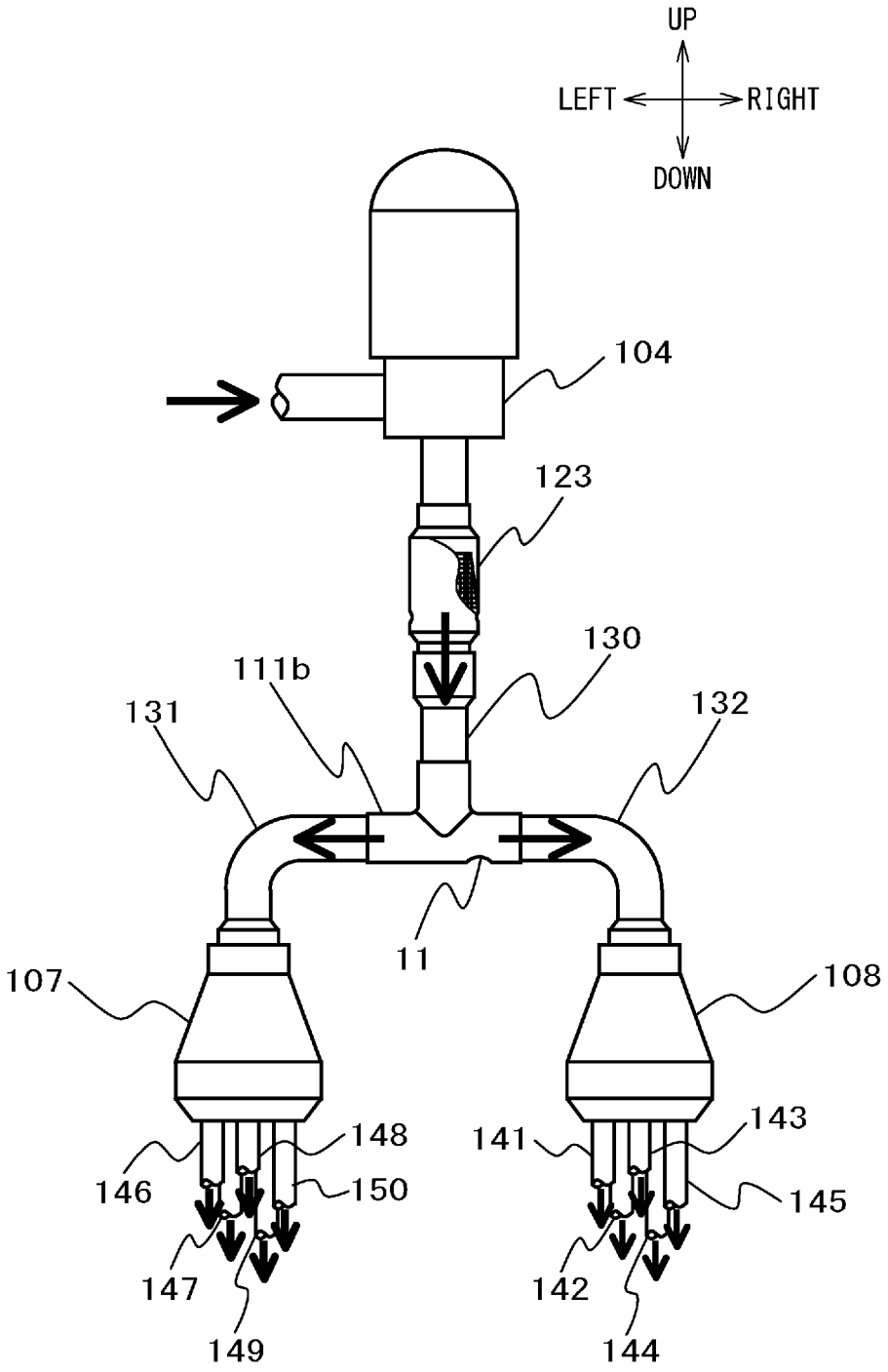
FIG. 7 is a schematic view showing the refrigerant distribution system according to a second embodiment.

FIG. 7 is a schematic view showing a refrigerant distribution system according to the embodiment. Referring to FIG. 7, the same components as those of the first embodiment will be designated with the same codes, which will be described while focusing on the feature different from the first embodiment.

The embodiment includes a recess portion 11 formed in the right lower wall surface of the straight part of a branch pipe 111*b* which partially reduces the flow path area, thus increasing the flow resistance. This makes it possible to decrease the flow rate of the refrigerant flowing rightward.

In the outdoor unit, dependent on arrangement of the components such as the compressor, the flow rate of air passing through the respective heat exchangers cannot be necessarily retained the same. For example, in the case of the outdoor unit 10 as shown in FIG. 3, the compressor 101 and the accumulator 103 which are disposed inside the outdoor heat exchanger 106 interfere with the air flow. Accordingly, as the flow rate of air passing through the outdoor heat exchanger 106 is decreased to be lower compared with the outdoor heat exchanger 105, the heat exchanging capacity is deteriorated. In order to use the outdoor heat exchanger 106 efficiently, the flow rate of the flowing refrigerant has to be reduced.

The embodiment as shown in FIG. 7 is configured to ensure adjustment of the refrigerant distribution in accordance with each heat exchanging capacity of the respective heat exchangers so as to solve the aforementioned problem. The recess portion 11 will not cause separation of the refrigerant into the gas phase and the liquid phase, but divide the refrigerant in the spray flow state. This makes it possible to avoid adverse effect of manufacturing variation.

Figure 8:
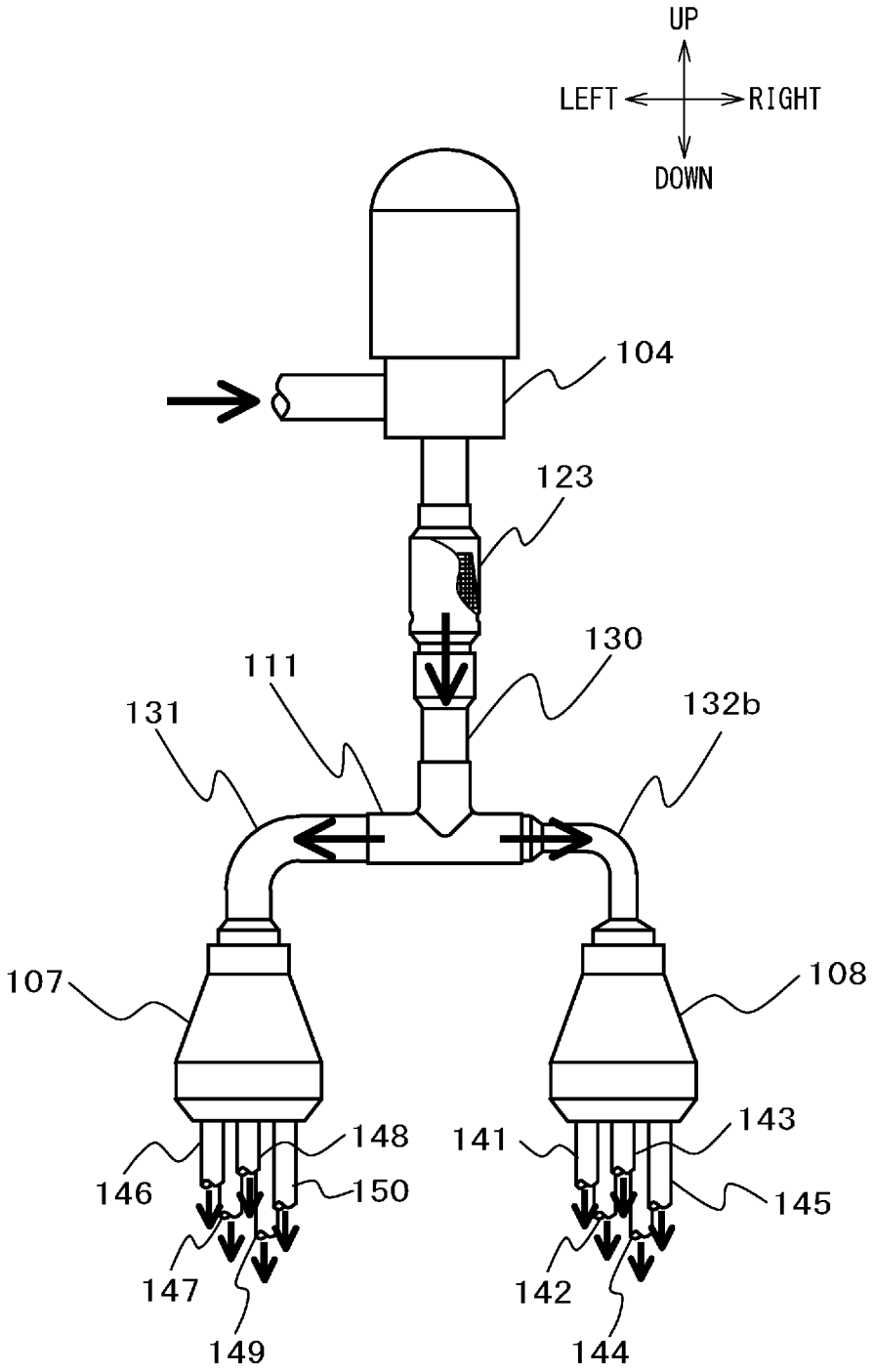
FIG. 8 is a schematic view showing another example of the refrigerant distribution system according to the second embodiment.

As another example of adjusting the refrigerant distribution, it is possible to reduce the thickness of a piping 132*b* for connecting the branch pipe 111 and the distributor 108 as shown in FIG. 8. It is also possible to provide an orifice in the distributor 108.

The outdoor unit of upward blow-off type for the air conditioner has been described as an example. The present invention is applicable to the outdoor unit or the indoor unit of any other type, or the other equipment using the refrigeration cycle.

It is possible to apply the aforementioned refrigerant distribution system having the single heat exchanger.

The present invention which has been described with respect to the embodiments is not limited to those described above, but includes various modifications. For example, the embodiments are described in detail for readily understanding of the present invention which is not necessarily limited to the one equipped with all structures as described above. It is possible to replace a part of the structure of one embodiment with the structure of another embodiment. The one embodiment may be provided with an additional structure of another embodiment. It is further possible to add, remove, and replace the other structure to, from and with a part of the structure of the respective embodiments.

The invention claimed is:

1. An air conditioner including an expansion valve for decompressing a refrigerant and a heat exchanger for heat exchange between the refrigerant and air, the air conditioner comprising:

a first linearly shaped piping that is connected to the expansion valve and vertically disposed;

a branch pipe including an upper connection portion connected to the first piping and including first and second branch portions each oriented perpendicular with respect to the first linearly shaped piping such that the refrigerant flows through each of the first and second branch portions in a horizontal plane perpendicular to the upper connection portion;

a first L-shaped piping having a bend at a right angle and having one end connected to the first branch portion and another end connected to a first distributor; and a second L-shaped piping having a bend at a right angle and having one end connected to the second branch portion and another end connected to a second distributor, wherein the first distributor and the second distributor further branch a refrigerant flow path to the heat exchanger and are vertically disposed.

2. The air conditioner according to claim 1, wherein the refrigerant flow path after each respective right angle bend of the first L-shaped piping and the second L-shaped piping is parallel to the flow path of the refrigerant through the first linearly shaped piping.

3. The air conditioner according to claim 1, wherein one of the first and second branch portions of the branch pipe has a recess disposed thereon.

4. The air conditioner according to claim 1, wherein the first L-shaped piping and the second L-shaped piping have a different flow resistance in the refrigerant flow path from the branch pipe to the first and second distributors.

5. The air conditioner according to claim 1, wherein a strainer is disposed between the expansion valve and the first piping.

6. The air conditioner according to claim 1, wherein the refrigerant flow path in each of the first and second distributors is vertically oriented.

7. The air conditioner according to claim 1, wherein a plurality of heat exchangers are provided.

* * * * *